US005711391A

United States Patent [19]

Brandt et al.

[11] Patent Number: 5,711,391

[45] Date of Patent: Jan. 27, 1998

[54] AUXILIARY INTERLOCK CONTROL SYSTEM FOR POWER MACHINE

[75] Inventors: Kenneth A. Brandt, Wyndmere; Scott B. Jacobson, Kindred, both of N. Dak.

[73] Assignee: Clark Equipment Company, Woodcliff Lake, N.J.

[21] Appl. No.: 664,403

[22] Filed: Jun. 17, 1996

[51] Int. Cl.[6] ..... B60K 28/04

[52] U.S. Cl. ..... 180/273

[58] Field of Search ..... 180/272, 273

[56] References Cited

U.S. PATENT DOCUMENTS

| | | | |
|---|---|---|---|
| 4,162,714 | 7/1979 | Correll | 180/53.1 |
| 4,392,543 | 7/1983 | Buckhouse et al. | 180/272 |
| 4,699,561 | 10/1987 | Tee | 180/273 |
| 4,844,196 | 7/1989 | Clevenger, Jr. et al. | 180/273 |
| 4,856,612 | 8/1989 | Clevenger, Jr. et al. | 180/273 |
| 4,871,044 | 10/1989 | Strosser et al. | 180/273 |
| 5,174,115 | 12/1992 | Jacobson et al. | 60/484 |
| 5,203,440 | 4/1993 | Peterson, Jr. et al. | 192/0.094 |
| 5,205,181 | 4/1993 | Wright | 47/480 R |
| 5,425,431 | 6/1995 | Brandt et al. | 180/273 |
| 5,577,876 | 11/1996 | Haeder et al. | 180/273 |
| 5,610,814 | 3/1997 | Sugioka et al. | 180/273 |

*Primary Examiner*—Kenneth R. Rice

*Attorney, Agent, or Firm*—Westman, Champlin & Kelly, P.A.

[57] ABSTRACT

A skid steer loader has an auxiliary coupling device connected to the hydraulic circuit of the skid steer loader. An auxiliary control circuit includes a hydraulic valve coupled between the hydraulic circuit of the skid steer loader and the auxiliary coupling device. The auxiliary control circuit is coupled to an operator input and controls flow of hydraulic fluid between the hydraulic circuit of the skid steer loader and the auxiliary coupling device based on a control signal received from the operator input. In addition, a controller is coupled to an operating mode sensor and to the auxiliary control circuit and provides an output to control operation of the hydraulic valve controlling flow to the auxiliary coupling device based on the status of the operating mode sensor.

21 Claims, 4 Drawing Sheets

AUXILIARY INTERLOCK CONTROL SYSTEM FOR POWER MACHINE

INCORPORATION BY REFERENCE

The following patents and patent applications are hereby fully incorporated by reference:

Brandt et al. U.S. Pat. No. 5,425,431, issued Jun. 20, 1995;

Jacobson et al. U.S. Pat. No. 5,174,115, issued Dec. 29, 1992; and

Co-pending U.S. patent application Ser. No. 08/435,601, filed May 5, 1995, entitled HYDRAULIC CONTROL SYSTEM PROVIDING PROPORTIONAL MOVEMENT TO AN ATTACHMENT OF A POWER MACHINE and assigned to the same assignee as the present application.

BACKGROUND OF THE INVENTION

The present invention deals with power machines, such as skid steer loaders. More specifically, the present invention deals with providing an interlock control system for controlling auxiliary hydraulic fluid flow in a power machine.

Power machines, such as skid steer loaders, typically have a frame which supports a cab or operator compartment and a movable lift arm which, in turn, supports a work tool such as a bucket. The movable lift arm is pivotably coupled to the frame of the skid steer loader and is powered by power actuators which are commonly hydraulic cylinders. In addition, the tool is coupled to the lift arm and is powered by one or more additional power actuators which are also commonly hydraulic cylinders. An operator manipulating a skid steer loader raises and lowers the lift arm, and manipulates the tool, by actuating the hydraulic cylinders coupled to the lift arm, and the hydraulic cylinder coupled to the tool.

Skid steer loaders also commonly have an engine which drives a hydraulic pump. The hydraulic pump powers hydraulic traction motors which provide powered movement of the skid steer loader. The traction motors are commonly coupled to the wheels through a drive mechanism such as a chain drive.

Front attachments, such as augers or angle brooms, typically include their own hydraulic drive motors and are attachable or mountable to the lift arm. An auxiliary hydraulic system is used to control the flow of hydraulic fluid between a hydraulic pump on the loader and the hydraulic motor on the front mounted attachment.

In addition, rear mounted attachments, such as stabilizers, are commonly attached or mounted to a rear portion of the loader. The rear mounted attachments also typically include their own hydraulic motors and are also supplied with hydraulic fluid from a pump which is controlled by an auxiliary hydraulic system on the loader.

In one prior skid steer loader, only a single auxiliary hydraulic power circuit is provided and a diverter valve is provided to route hydraulic fluid from the front mounted attachment to the rear mounted attachment. Thus, either the front or rear mounted attachment is operable at one time. In another prior loader, the auxiliary hydraulic power circuit is configured to allow simultaneous operation of both front and rear mounted attachments.

It is also common for control levers in skid steer loaders to have hand grips which support a plurality of buttons or actuable switches, actuable by the operator to perform certain functions. These buttons or switches are used by the operator to control the auxiliary hydraulic system to selectively manipulate the front and rear mounted attachments.

It is desirable that, under certain circumstances, the lift arm, the tool, the traction mechanism, or all three, be rendered inoperable. For example, in some prior loaders, when an operator leaves the cab of the skid steer loader or assumes an improper operating position, the hydraulic cylinders used to raise and lower the lift arm are locked out of operation. In such prior devices, an operator presence switch or sensor is coupled to the hydraulic circuit controlling the hydraulic cylinders to provide a signal indicative of operator presence. The hydraulic lift cylinders are rendered inoperable when the operator presence switch indicates that the operator is in an improper operating position. One example of such a system is set out in the Minor et al. U.S. Pat. No. 4,389,154.

In addition, in some prior loaders, movable operator restraint bars are provided. When the operator restraint bars are moved to a retracted or inoperative position, mechanical breaks or wheel locks lock the wheels of the skid steer loader. One example of such a system is set out in the Simonz U.S. Pat. No. 4,955,452.

Further, a system which has both a seat sensor and a seat bar sensor, as well as an operator override system, all of which are used to selectively lock out or enable the operation of the drive mechanism and the hydraulic lift cylinders, is disclosed in the Brandt et al. U.S. Pat. No. 5,425,431.

SUMMARY OF THE INVENTION

The present invention arises from the realization that, under certain circumstances, it is desirable to have the auxiliary hydraulic system also controlled based on one or a plurality of sensors which provide signals indicative of operator position or of the machine being in an operable state. The present invention also arises from the realization that, under certain circumstances, it is advantageous to override this system, thus allowing operation of the auxiliaries, regardless of whether the operator is seated on the seat of the skid steer loader or regardless of the position of the skid steer loader.

The present invention is drawn to a power machine, such as a skid steer loader, having an auxiliary coupling device connected to the hydraulic circuit of the skid steer loader. An auxiliary control circuit includes a hydraulic valve coupled between the hydraulic circuit of the skid steer loader and the auxiliary coupling device. The auxiliary control circuit is coupled to an operator input device and controls flow of hydraulic fluid between the hydraulic circuit of the skid steer loader and the auxiliary coupling device based on a control signal received from the operator input device. In addition, a controller is coupled to an operational sensor and to the auxiliary control circuit and provides an interruption signal to control operation of the hydraulic valve based on the status of the operational sensor.

In one preferred embodiment, the auxiliary control circuit is configured to override the interruption signal so that it can be reactivated, even after operation of the auxiliary valve is interrupted.

DETAILED DESCRIPTION OF THE PREFERRED EMBODIMENTS OVERVIEW

Figure 1:
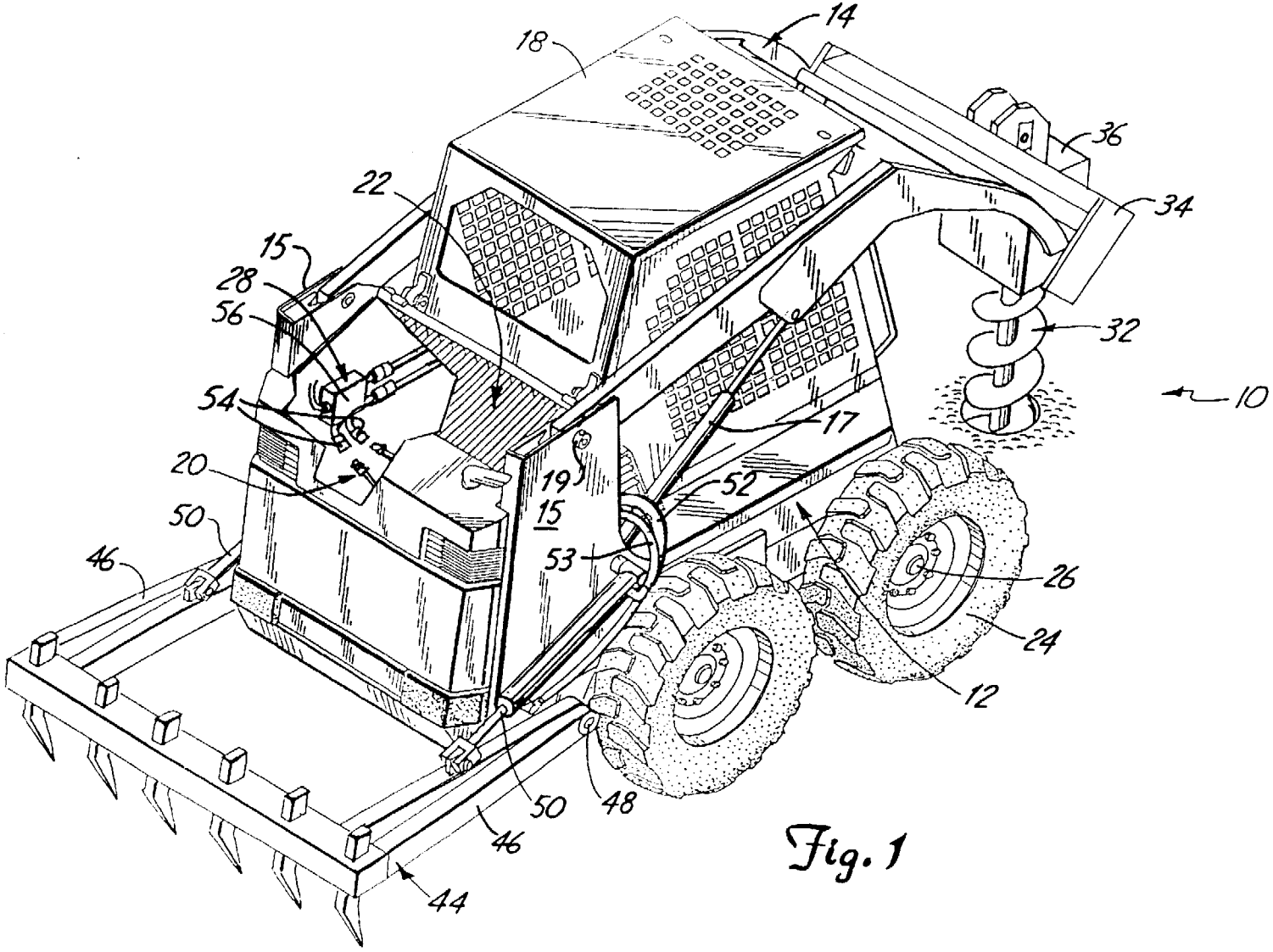
FIG. 1 is a perspective view taken from the right rear side of a skid steer loader according to the present invention.
Figure 2:
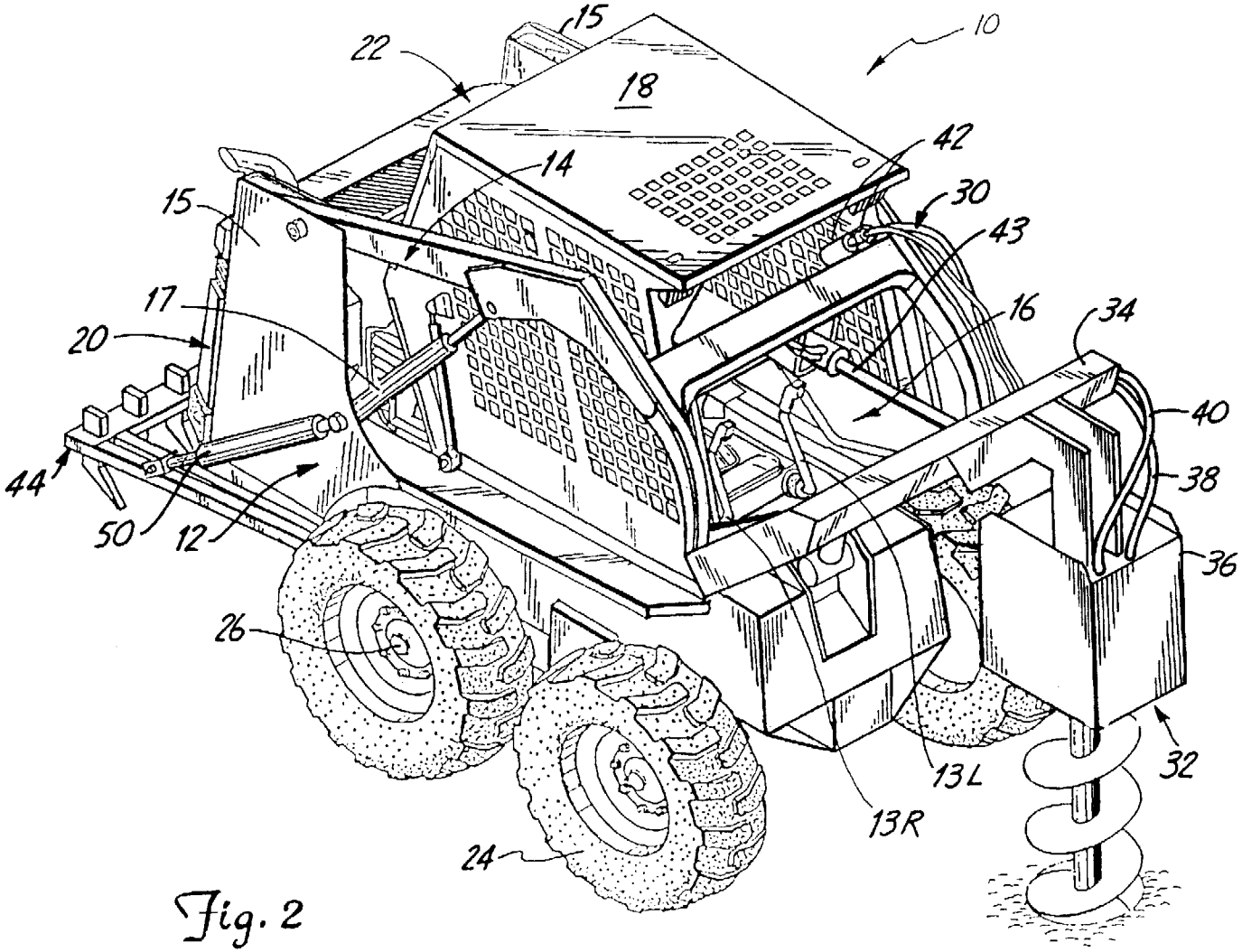
FIG. 2 is an illustration of the loader shown in FIG. 1 taken from the right front side.

FIGS. 1 and 2 illustrate a skid steer loader 10 according to the present invention. Loader 10 includes a main frame assembly 12 which is preferably mounted to a lower frame assembly or transmission case (not shown). Loader 10 also includes lift arm 14, operator compartment 16 (preferably defined by a cab 18), engine compartment 20, heat exchanger compartment 22, and wheels 24 preferably mounted to main frame assembly 12 by stub axles 26. FIG. 1 also has a portion of engine compartment 20 and heat exchanger compartment 22 cut away to reveal a portion of a rear auxiliary hydraulic circuit 28. Further, FIG. 2 shows a portion of a front auxiliary hydraulic circuit 30.

Lift arm 14 is pivotably attached to upright portions 15 of main frame assembly 12 at pivot points 19. A pair of hydraulic actuators 17 are also coupled to lift arm 14 and main frame assembly 12. When the operator of loader 10 causes hydraulic actuators 17 to extend, lift arm 14 pivots about pivot points 19 in an upward direction. Similarly, when the operator of loader 10 operates the loader to cause hydraulic actuator 17 to retract, lift arm 14 pivots about pivot points 19 in a downward or lowered direction.

Loader 10 in FIGS. 1 and 2 is depicted with both a front attachment and a rear attachment. The front attachment is auger 32 which is mounted to lift arm 14 by a front attachment mount 34. Auger 32 includes a hydraulic motor (not shown) housed in motor housing 36. Hydraulic power is preferably provided to the hydraulic motor in auger 32 through hoses 38 and 40 which are coupled to the front auxiliary hydraulic circuit 30 by hose coupling members 42. Of course, coupling members 42 can be placed at any suitable location on loader 10.

The hydraulic motor located in housing 36 powers rotation of auger 32. By selectively providing fluid under pressure through hoses 38 and 40, the direction of rotation of auger 32 is controlled in a known manner.

A tilt cylinder 43 is also coupled to both main frame assembly 12 and auger 32. In some loaders, a plurality of cylinders 43 are used. Auger 32 is pivotably mounted by front mounting attachment 34 to lift arm 14. Therefore, when the operator of loader 10 causes tilt cylinder 43 to retract, this causes auger 32 to rotate relative to lift arm 14 in an upward and outward direction. Similarly, when the operator of loader 10 causes tilt cylinder 43 to extend, this causes auger 32 to rotate relative to lift arm 14 inwardly toward loader 10.

The rear mounted attachment shown in FIGS. 1 and 2 is a rear scarifier 44 which includes a pair of generally parallel elongate members 46 which are pivotably attached to main frame assembly 12 at pivot points 48. Scarifier 44 is also attached to uprights 15 by a pair of hydraulic cylinders 50 (i.e., linear hydraulic motors). Hydraulic cylinders 50 are controllable by the operator of loader 10 to raise and lower scarifier 44 in an arc about pivot points 48. The hydraulic fluid is provided to cylinders 50 through hoses 52 and 53 which are couplable to rear auxiliary hydraulic circuit 28 through hydraulic hose coupling members 54. Of course, coupling members 54 can be located at any suitably place on loader 10. Rear auxiliary hydraulic control circuit 28 preferably includes one or more electrically actuable control valves housed in valve housing 56. The control valves control the provision of hydraulic fluid to cylinders 50 through hoses 52 to accomplish desired operations (e.g., extension or retraction of cylinders 50).

FIG. 2 shows operator control handles 13R and 13L in operator compartment 16. Control handles 13R and 13L can be moved in a forward and rearward direction to control the speed and direction of rotation of wheels 24 in a known manner.

Figure 3:
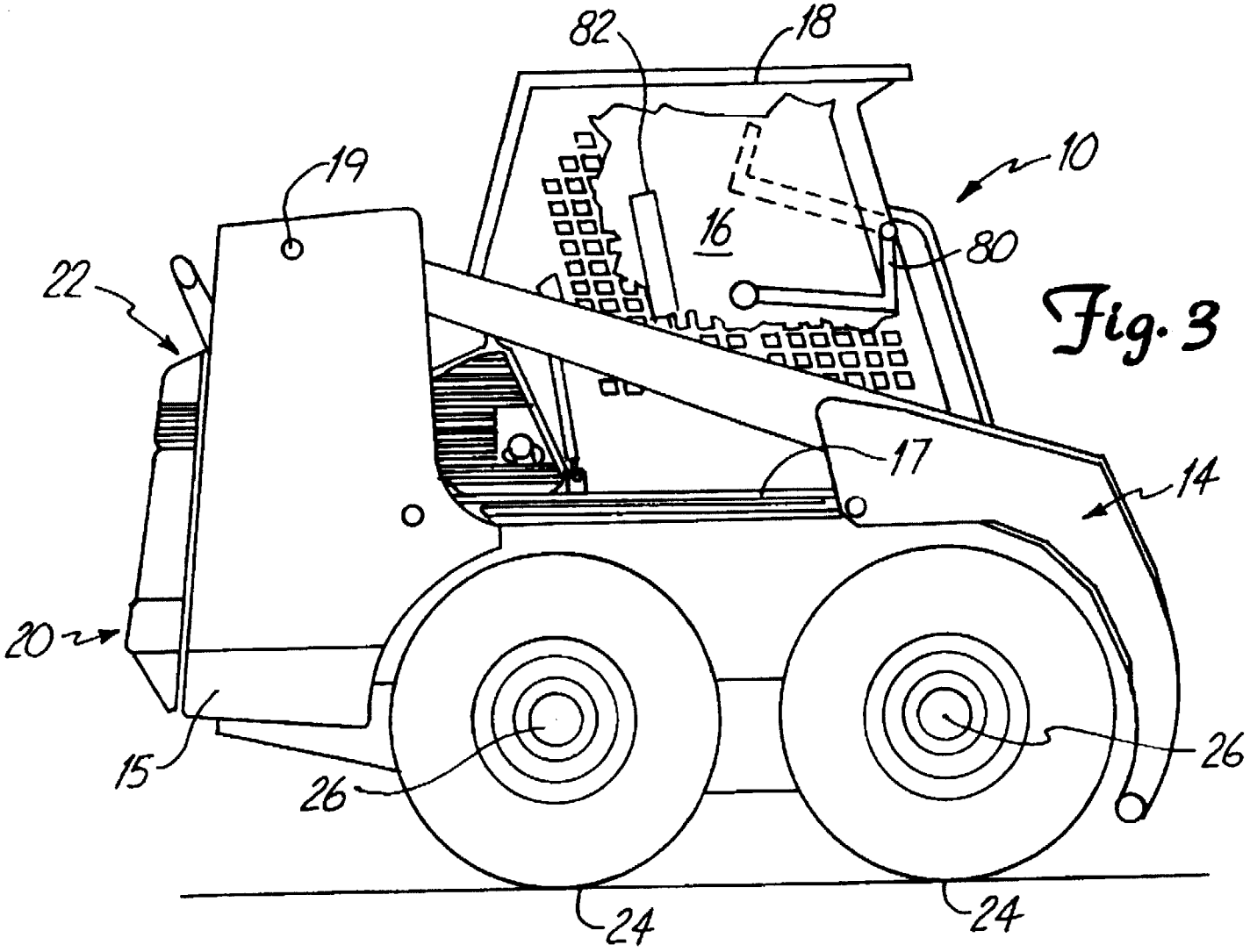
FIG. 3 is a side elevational view of a skid steer loader without front or rear attachments.

FIG. 3 is a side elevational view of skid steer loader 10, without front and rear attachments 32 and 44, respectively. FIG. 3 shows that a seat 82, on which an operator sits to control skid steer loader 10, is substantially enclosed by cab 18. In addition, FIG. 3 shows a seat bar 80 pivotally coupled to a front portion of cab 18. Typically, after the operator occupies seat 82, the operator then pivots seat bar 80 from the raised position (shown in phantom in FIG. 3) to the lowered position shown in FIG. 3.

CONTROL SYSTEM 84

Figure 4:
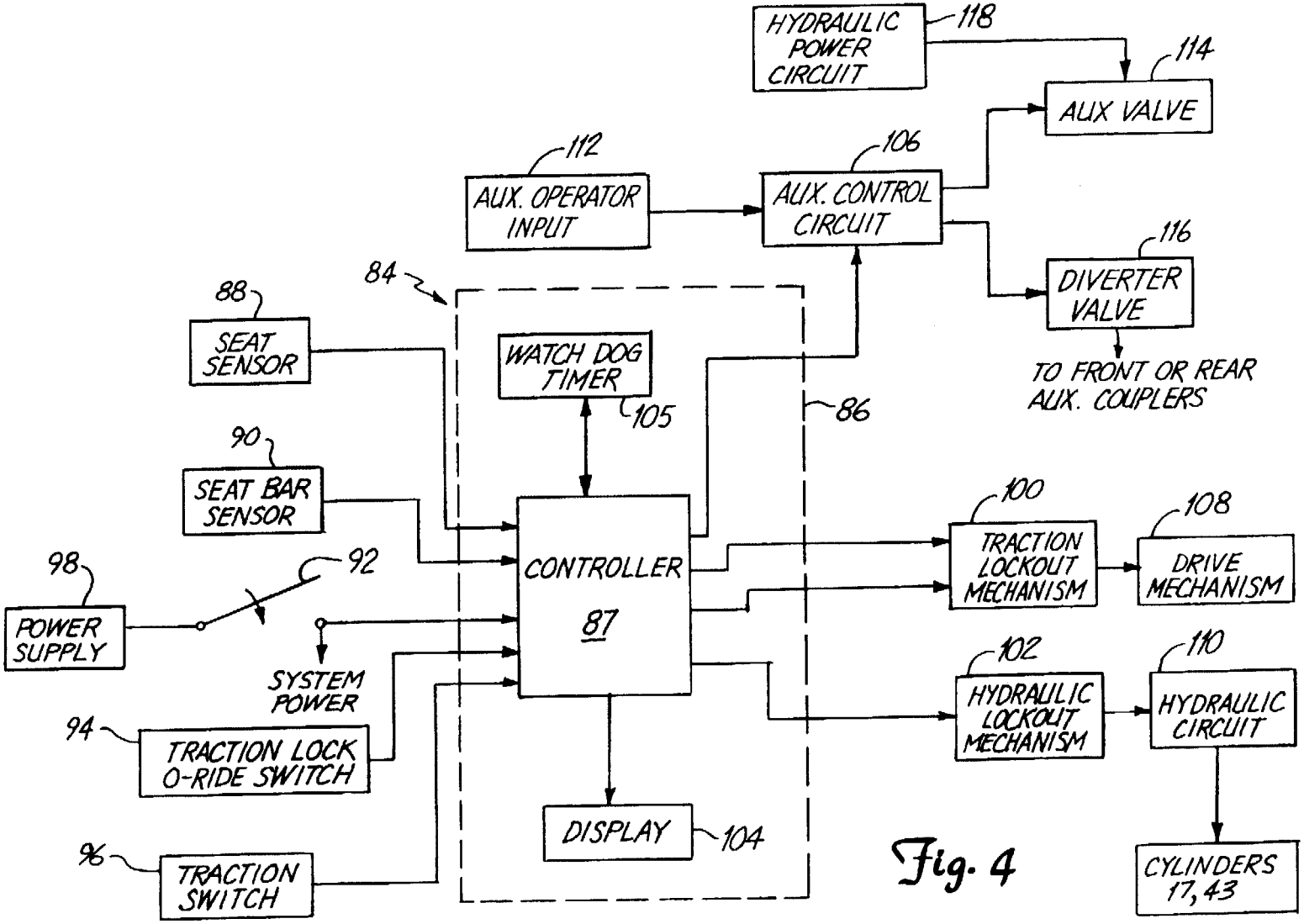
FIG. 4 is a block diagram of an auxiliary control system according to the present invention.

FIG. 4 is a block diagram of a control system 84 according to the present invention. Control system 84 includes an interlock controller 86 which includes controller 87, display 104 and watchdog timer 105. In a preferred embodiment, display 104 and watchdog timer 105 are integrated with interlock controller 86. Interlock controller 86 receives inputs from seat sensor 88, seat bar sensor 90, ignition switch 92, traction lock override switch 94 and traction lock switch 96. Ignition switch 92 is coupled to a power supply 98. Upon closing of ignition switch 92, power is supplied from power supply 98 to the remainder of the system.

Based on the inputs received, interlock controller 86 provides two outputs to traction lockout mechanism 100, an output to hydraulic lockout mechanism 102, an output to display 104, an output to watchdog timer 105, and an output to auxiliary control circuit 106. Based on the inputs from interlock controller 86, the traction lockout mechanism 100 and hydraulic lockout mechanism 102 provide outputs to drive mechanism 108 and hydraulic circuit 110, respectively. Hydraulic circuit 110, in turn, provides an output to cylinders 17 and 43.

The interaction of interlock controller 86 with seat sensor 88, seat bar sensor 90, ignition switch 92, traction lock override switch 94 and traction switch 96, and the outputs based on those inputs, is described in detail in U.S. Pat. No. 5,425,431 to Brandt et al. and is hereby fully incorporated by reference. In another preferred embodiment, the operator is in a known occupying position (and loader 10 is in an operable state) when the seat bar 80 is down and the seat 82 is occupied. Then, when controller 86 receives a signal from seat bar sensor 90 indicating that the seat bar 80 has been raised, controller 86 provides outputs to traction lockout mechanism 100 to selectively preclude the drive mechanism 108 from driving wheels 24. Also, controller 86 provides an output to hydraulic lockout mechanism 102 causing hydraulic circuit 110 to disable certain operations of cylinders 17 and 43.

AUXILIARY CONTROL SYSTEM

According to the present invention, controller 86 also provides an output signal to auxiliary control circuit 106 based on the various signals received by controller 86. In the preferred embodiment, auxiliary control circuit 106 is coupled to auxiliary operator input devices 112, auxiliary valve 114 and diverter valve 116. Auxiliary valve 114, in the preferred embodiment, is coupled to receive hydraulic fluid under pressure from hydraulic power circuit 118 of skid steer loader 10. Auxiliary valve 114 is controllable by auxiliary control circuit 106 to provide the hydraulic fluid under pressure in either a forward or a reverse direction to diverter valve 116. Diverter valve 116 is also controllable by auxiliary control circuit 106 and, in the preferred embodiment, diverts flow of the hydraulic fluid under pressure to either the front or rear auxiliary couplers 42,54 on skid steer loader 10. Of course, in another preferred embodiment, two auxiliary valves 114 are controlled by auxiliary control circuit 106 to provide hydraulic fluid under pressure simultaneously, and independently, to both the front and the rear auxiliary couplers 42,54 of skid steer loader 10.

Auxiliary control circuit 106 receives an input from auxiliary operator input devices 112. One embodiment of auxiliary operator input devices 112 is described in greater detail in U.S. Pat. No. 5,174,115 to Jacobson et al., which is fully incorporated herein. Briefly, auxiliary operator input devices 112 include push buttons or other actuable switches located on the hand grips of levers 13L and 13R, or located at another easily accessible place in the dash area of cab 18. As indicated in the Jacobson '115 patent, the operator can operate the front or rear auxiliaries in either a momentary mode, in which hydraulic fluid under pressure is provided to the front or rear auxiliaries (as selected by the operator) only as long as the operator has the actuable switch depressed. However, the operator can also operate the front or rear auxiliaries in a detent mode in which the operator need only depress the actuable switch one time, and hydraulic fluid under pressure will be provided to the desired front or rear auxiliaries (or both) until the operator releases the detent mode by actuating the switch a second time.

Auxiliary control circuit 106 receives the inputs from auxiliary operator input devices 112 and controller 86 and controls auxiliary valve 114 and diverter valve 116. In one preferred embodiment, auxiliary control circuit 106 corresponds to that circuit shown in the Jacobson et al. '115 patent and operates valves 114 and 116 in an on/off mode. In other words, auxiliary control circuit 106 provides an output to valves 114 and 116 which either causes the valves to be in the fully opened or fully closed position based on the operator inputs.

In another embodiment, however, auxiliary control circuit 106 corresponds to the controller described in copending U.S. patent application Ser. No. 08/435,601, filed May 5, 1995, assigned to the same assignee as the present application, and which is also hereby incorporated by reference. In the incorporated patent application, auxiliary control circuit 106 includes a microprocessor which controls the solenoids associated with the auxiliary valves in a continuous fashion using, for example, pulse width modulation or pulse frequency modulation. The valves are controlled in a variable manner between the full open and full closed position. In that embodiment, auxiliary operator input devices 112 are preferably manually actuable rocker switches which are biased to a central position and which are coupled to a potentiometer. The microprocessor controls the solenoids based on the inputs from the potentiometer in a continuous fashion. In this way, the auxiliaries provide more smooth transitioning between full on and full off states, and also provide more smoothly controllable outputs, with finer control resolution.

NORMAL OPERATION

During normal operation of control circuit 84, an operator enters the operator compartment 16 defined by cab 18 and occupies seat 82. The operator then lowers seat bar 80 into the lowered position shown in FIG. 3. The operator then closes ignition switch 92 supplying power to the basic electrical system and to interlock controller 86 and to the remainder of the control system 84. Sensors 88 and 90 provide signals to controller 86 indicating that seat 82 is occupied and that seat bar 80 is in the lowered position. It should be noted that the signals from seat sensor 88 and seat bar sensor 90 need not be provided to controller 86 in any particular sequence. Rather, controller 86 must simply receive the signals from the appropriate sensors, regardless of the sequence, in order to allow continued operation of loader 10. In a preferred embodiment, if the seat bar is lowered before the seat is occupied, an appropriate delay, such as ten seconds is implemented before further operation is enabled.

Upon receiving the appropriate signals, controller 86 enables drive mechanism 108 and hydraulic circuit 110 so that the loader 10 can be moved and driven, and so that cylinders 17 and 43 can be manipulated by the operator. In addition, controller 86 allows the operator to manipulate the auxiliaries by manipulating the auxiliary operator input devices 112 without interruption.

INTERRUPT OPERATION

However, if the operator has been in the known occupying state (with the seat occupied and the seat bar down) and if seat bar sensor 90 provides a signal indicating that the seat bar 80 has been moved out of the lowered position (loader 10 is not in a normal operating position), controller 86 provides appropriate signals to traction lockout mechanism 100 and hydraulic lockout mechanism 102 to lock out certain functions of skid steer loader 10. This is described in greater detail in the Brandt '431 patent. In addition, under these circumstances, controller 86 provides a signal to auxiliary control circuit 106 indicating the status of seat sensor 88 and seat bar sensor 90. In response, auxiliary control circuit 106 controls auxiliary valve 114 and diverter valve 116 accordingly.

In the preferred embodiment, upon receiving such a signal from controller 86, auxiliary control circuit 106 controls auxiliary valve 114 such that, if it is then providing hydraulic fluid under pressure to diverter valve 116, auxiliary valve 114 is moved to its closed position so that the hydraulic fluid under pressure is no longer provided to either the front or rear auxiliaries.

Also, in the preferred embodiment, the signal provided by controller 86 to auxiliary control circuit 106 is only an operational interrupt signal. In other words, auxiliary control circuit 106 is configured to receive the interrupt signal from controller 86 indicating that the seat bar 80 has been moved out of its lowered position. In response, auxiliary control circuit 106 interrupts present operation of the auxiliaries, but does not preclude future operation of the auxiliaries if the operator reactuates the auxiliary operator input device 112.

For instance, it may be desirable to shut off hydraulic fluid flow to the auxiliaries if the auxiliaries are currently being operated and the operator raises seat bar 80. However, it may also be desirable, under certain circumstances, to allow the operator to restart the auxiliaries regardless of whether seat 82 is occupied or whether seat bar 80 is in the lowered position (i.e., regardless of the state of loader 10 with respect to seat 80 and seat bar 82). Therefore, even after receiving the interrupt signal from controller 86, auxiliary control circuit 106 is configured to restart operation of the auxiliaries upon receiving a command to do so from auxiliary operator input devices 112.

This can be accomplished in any number of suitable ways. In one preferred embodiment, auxiliary control circuit 106 is configured to detect a signal transition provided in the interrupt signal from controller 86. Upon detecting such a transition, auxiliary control circuit 106 closes auxiliary valve 114 precluding hydraulic fluid flow to the auxiliaries. However, if the operator provides a signal through auxiliary operator input devices 112 to auxiliary control circuit 106 requesting that the operation of the auxiliaries be resumed, auxiliary control circuit 106 again opens auxiliary valve 114 and resumes operation, as usual, unless it receives another appropriate signal transition from controller 86. In the preferred embodiment, auxiliary control switch 106 is configured to only detect a transition in one direction (such as a negative going signal transition) from controller 86.

In the preferred embodiment in which auxiliary control circuit 106 comprises the electrical control circuit set out in the Jacobson et al. '115 patent, a resettable mode counter is employed which has three modes of operation. When the mode counter provides a zero output, the auxiliary valves are closed so that no hydraulic fluid under pressure is provided to the auxiliaries. When the mode counter provides a logical one output, the auxiliaries are operable in the momentary mode only and when the mode counter provides a logical two output, the auxiliaries are operable in either the momentary or in the detent mode. In that embodiment, the interrupt signal provided by controller 86 is provided to the reset input of the mode counter such that, upon receiving the positive going transition from controller 86, the mode counter is reset to zero thereby causing auxiliary valve 114 to close.

In the preferred embodiment in which auxiliary control circuit 106 comprises the electronic controller (or microprocessor) described in the above-mentioned copending Jacobson patent application, the signal provided by controller 86 is simply provided to a suitable input to the electronic controller. The electronic controller is programmed to detect the transition of that input from a logic high level to a logic low level and close auxiliary valve 114 in response to that transition.

In either of the above two preferred embodiments, auxiliary control circuit 106 is configured to resume normal operation of the auxiliaries upon receiving another request to do so from the auxiliary operator input devices 112. Further operation of the auxiliaries continues as normal unless and until another interrupt signal (in this preferred embodiment, a negative going signal transition) is received from controller 86.

Therefore, the present invention provides a highly flexible system for controlling the auxiliary outputs on a power machine, such as a skid steer loader. The auxiliaries are preferably controlled based on a plurality of sensor inputs to an already existing interlock controller. However, in order to accommodate a wide variety of circumstances, the control signal from the controller can be overridden by the operator to accomplish continued operation of the auxiliaries.

Although the present invention has been described with reference to preferred embodiments, workers skilled in the art will recognize that changes may be made in form and detail without departing from the spirit and scope of the invention.

What is claimed is:

1. An apparatus for controlling operation of a skid steer loader having a frame, wheels supporting the frame, a seat supported by the frame, a drive mechanism for driving the wheels, a lift arm structure manipulated by hydraulic actuators, and a hydraulic circuit providing hydraulic fluid under pressure to the hydraulic actuators, the apparatus comprising:

an operating state sensor, coupled to the skid steer loader, providing an operation signal indicative of whether the skid steer loader is in an operational state;

a traction locking apparatus, coupled to the drive mechanism, for selectively locking the drive mechanism to preclude driving of the wheels;

a first hydraulic valve coupled to at least a first of the hydraulic actuators to control flow of hydraulic fluid between the hydraulic circuit and the first hydraulic actuator;

an auxiliary coupling device, connected to the hydraulic circuit, for providing hydraulic fluid under pressure to an output thereof;

an auxiliary operator input providing an auxiliary control signal based on an operator input;

an auxiliary control circuit including a second hydraulic valve coupled between the hydraulic circuit and the auxiliary coupling device, the auxiliary control circuit being coupled to the auxiliary operator input and controlling flow of hydraulic fluid between the hydraulic circuit and the auxiliary coupling device based on the auxiliary control signal; and a controller coupled to the operating state sensor, the traction locking apparatus, the first hydraulic valve and the auxiliary control circuit and providing an output to control operation of the traction locking mechanism, the first hydraulic valve and the auxiliary control circuit based on the operation signal.

2. The apparatus of claim 1 wherein the output provided by the controller includes an auxiliary interrupt signal provided to the auxiliary control circuit to interrupt flow of hydraulic fluid through the auxiliary coupling device.

3. The apparatus of claim 2 wherein the auxiliary control circuit is configured to resume flow of hydraulic fluid between the hydraulic circuit and the auxiliary coupling device based on activation of the auxiliary control signal after receiving the auxiliary interrupt signal.

4. The apparatus of claim 3 wherein the auxiliary control circuit interrupts flow of the hydraulic fluid through the auxiliary control device based on a transition in the auxiliary interrupt signal.

5. The apparatus of claim 1 wherein the auxiliary control circuit comprises:

an electronic controller coupled to the auxiliary operator input and controlling the second hydraulic valve to be positioned a variable amount between full open and full closed based on the auxiliary control signal and causing the second hydraulic valve to move to the full closed position based on the auxiliary interrupt signal.

6. The apparatus of claim 1 wherein the auxiliary control circuit comprises:

an on/off control circuit configured to move the second hydraulic valve to one of a full open position and a full closed position based on the auxiliary control signal.

7. The apparatus of claim 1 wherein the auxiliary operator input configured to provide a momentary operation signal causing the auxiliary control circuit to operate the second hydraulic valve in a momentary mode, and a detent operation signal causing the auxiliary control circuit to operate the second hydraulic valve in one of a detent and the momentary modes.

8. The apparatus of claim 1 wherein the controller provides an operator output signal based, at least in part, on the operation signal and further comprising:

an operator output device providing an operator detectable output based on the operator output signal.

9. An apparatus for controlling operation of a skid steer loader having a frame, wheels supporting the frame, a seat supported by the frame, a drive mechanism for driving the wheels, a lift arm structure manipulated by hydraulic actuators, and a hydraulic circuit providing hydraulic fluid under pressure to the hydraulic actuators, the apparatus comprising:

an auxiliary coupling device connected to the hydraulic circuit to receive hydraulic fluid therefrom;

an auxiliary valve controlling flow of hydraulic fluid to the auxiliary coupling device;

an auxiliary valve control circuit coupled to the auxiliary valve and controlling the auxiliary valve;

an operating state sensor coupled to the skid steer loader and providing an operating state signal indicative of an operating state of the skid steer loader; and a controller coupled to the auxiliary valve control circuit and the operating state sensor and providing an auxiliary interrupt signal to the auxiliary valve control circuit based on the operating state signal, the auxiliary valve control circuit controlling the auxiliary valve based on the auxiliary interrupt signal and based on operator inputs to the auxiliary valve control circuit.

10. The apparatus of claim 9 and further comprising:

an operator input device, coupled to the auxiliary valve control circuit, providing an operator input signal indicative of the operator inputs.

11. The apparatus of claim 10 wherein the auxiliary valve control circuit is configured to close the auxiliary valve in response to receiving the auxiliary interrupt signal.

12. The apparatus of claim 11 wherein the auxiliary valve control circuit is configured to open the auxiliary valve based on the operator input signal after receiving the auxiliary interrupt signal, and prior to receiving a subsequent auxiliary interrupt signal, regardless of a then current state of the operating state sensor.

13. The apparatus of claim 12 wherein the auxiliary valve control circuit is configured to sense a transition in the auxiliary interrupt signal from a first logic level to a second logic level and close the auxiliary valve in response to the transition sensed.

14. The apparatus of claim 13 wherein the auxiliary valve control circuit is configured to control the auxiliary valve in an on/off manner.

15. The apparatus of claim 13 wherein the auxiliary valve control circuit is configured to control the auxiliary valve in a continuous manner.

16. The apparatus of claim 9 wherein the skid steer loader includes a seat bar movable between a first position and a second position, and wherein the operating state sensor comprises:

at least one of a seat sensor sensing occupancy in the seat, and a seat bar sensor sensing a position of the seat bar.

17. The apparatus of claim 9 and further comprising:

a traction locking apparatus, coupled to the drive mechanism, for selectively locking the drive mechanism to preclude driving of the wheels;

a first hydraulic valve coupled to at least a first of the hydraulic actuators to control flow of hydraulic fluid between the hydraulic circuit and the first hydraulic actuator; and wherein the controller is coupled to the traction locking apparatus and the first hydraulic valve and provides an output to control operation of the traction locking mechanism and the first hydraulic valve based on the operating state signal.

18. The apparatus of claim 17 wherein the hydraulic circuit includes a main hydraulic circuit portion and an auxiliary hydraulic portion wherein the first hydraulic valve is coupled in the main hydraulic circuit portion and wherein the auxiliary valve is coupled in the auxiliary hydraulic circuit portion.

19. A power machine comprising:

a frame;

wheels supporting the frame;

a seat supported by the frame;

a drive mechanism for driving the wheels;

a lift arm structure manipulated by power actuators;

a power circuit providing power to the power actuators; and a control apparatus comprising:

an auxiliary coupling device connected to the power circuit to receive power therefrom;

an auxiliary valve controlling application of power to the auxiliary coupling device;

an auxiliary valve control circuit coupled to the auxiliary valve and controlling the auxiliary valve;

an operating mode sensor coupled to the skid steer loader and providing an operating mode signal indicative of an operating mode of the skid steer loader; and a controller coupled to the auxiliary valve control circuit and the operating mode sensor and providing an auxiliary interrupt signal to the auxiliary valve control circuit based on the operating mode signal, the auxiliary valve control circuit closing the auxiliary valve based on the auxiliary interrupt signal and further controlling the auxiliary valve based on operator inputs to the auxiliary valve control circuit.

20. The power machine of claim 19 and further comprising:

a traction locking apparatus, coupled to the drive mechanism, for selectively locking the drive mechanism to preclude driving of the wheels;

a first valve coupled to at least a first of the power actuators to control application of power from the power circuit to the first power actuator; and wherein the controller is coupled to the traction locking apparatus and the first valve and provides an output to control operation of the traction locking mechanism and the first valve based on the operating mode signal.

21. The power machine of claim 19 wherein the auxiliary valve control circuit closes the auxiliary valve in response to detection of a predetermined transition in the auxiliary interrupt signal.

* * * * *